US006629864B2

(12) United States Patent
Schremmer et al.

(10) Patent No.: US 6,629,864 B2
(45) Date of Patent: Oct. 7, 2003

(54) ELECTRICAL CONTACT FOR PLUG-IN CONNECTOR

(75) Inventors: Andreas Michael Schremmer, Berglen (DE); Rene Körber, Leutenbach (DE)

(73) Assignee: ITT Manufacturing Enterprises, Wilmington, DE (US)

( * ) Notice: Subject to any disclaimer, the term of this patent is extended or adjusted under 35 U.S.C. 154(b) by 0 days.

(21) Appl. No.: 10/325,139

(22) Filed: Dec. 20, 2002

(65) Prior Publication Data

US 2003/0124918 A1 Jul. 3, 2003

(30) Foreign Application Priority Data

Dec. 28, 2001 (DE) ..... 101 64 366

(51) Int. Cl.[7] ..... H01R 13/05
(52) U.S. Cl. ..... 439/825; 439/848
(58) Field of Search ..... 439/866, 862, 439/884, 825, 848, 346

(56) References Cited

U.S. PATENT DOCUMENTS 4,932,903 A 6/1990 Bonhomme
5,004,438 A * 4/1991 Cabourne ..... 439/825
5,791,923 A * 8/1998 Picaud et al. ..... 439/825

FOREIGN PATENT DOCUMENTS

| | | | |
|---|---|---|---|
| DE | 2736664 C2 | | 2/1984 |
| DE | 4411306 C1 | | 5/1995 |
| DE | 4443010 C2 | | 7/1998 |
| EP | 0 407 249 A1 | * | 1/1991 |
| GB | 2363526 A | | 12/2001 |

* cited by examiner

*Primary Examiner*—Tho D. Ta
(74) *Attorney, Agent, or Firm*—Leon D. Rosen; Roger C. Turner

(57) ABSTRACT

An electrical contact (10) which can engage a mating terminal (50) for electrical connection and detachable latching thereto. The contact includes a piece of sheet metal bent to form at least one guide plate (13, 14) and a bias plate (15) lying facewise adjacent to the guide plate. The bias plate has a front end upper portion or nose (38) with a top (104) that lies above an adjacent location (24, 25) on the guide plate, but the nose can be resiliently downwardly deflected and then tends to spring up again. A recess (17) in the bottom of the guide plate front portion receives the mating terminal, and the upper bias of the nose of the bias plate keeps the guide plate pressed down against the terminal lying in its recess, to thereby latch the two connectors together.

17 Claims, 4 Drawing Sheets

ELECTRICAL CONTACT FOR PLUG-IN CONNECTOR

BACKGROUND OF THE INVENTION

A plug connector for applications such as in mobile telephones, commonly includes a row of contacts that make electrical connection with corresponding terminals on the mating connector, and a separate latch that holds the connectors together. It is possible for the contacts to provide some retention force, but such retention force is usually low so reliable latching requires a separate latch. It would be desirable if the contacts themselves provided a strong latch and the contacts could be constructed at low cost of sheet metal.

SUMMARY OF THE INVENTION

In accordance with one embodiment of the present invention, applicant provides a contact that includes a durable latch function in addition to an electrical contacting function, in a contact that can be constructed at low cost. The contact includes a piece of sheet metal that is bent to form a biasing plate and at least one guide plate, the two plates joined by a bend and the two plates lying facewise adjacent to each other. Front portions of the plates, which are designed to mate to a terminal of a matting connector, have tops and bottoms. The top of the front portion of the biasing plate forms a nose whose top initially lies above an adjacent location on the guide plate, but which can be resiliently deflected downwardly. Accordingly, when the front portion of the contact enters a cavity of the mating connector, the height of the contact can be reduced by downward deflection of the nose, and the contact then resiliently expands vertically.

The bottom of the guide plate has a recess that receives a terminal of the mating connector. The resilient vertical expansion of the contact, assures that the terminal presses firmly against the walls of the recess, and allows shoulders formed by the terminal and recess to resist pull out of the contact out of the cavity.

The contact is preferably formed with two guide plates, and with the bias plate sandwiched between the guide plates. The lower ends of the guide plates are joined by a longitudinally-extending bend that lies under the bias plate. The top of the bias plate is joined in a bend to the top of one of the guide plates.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
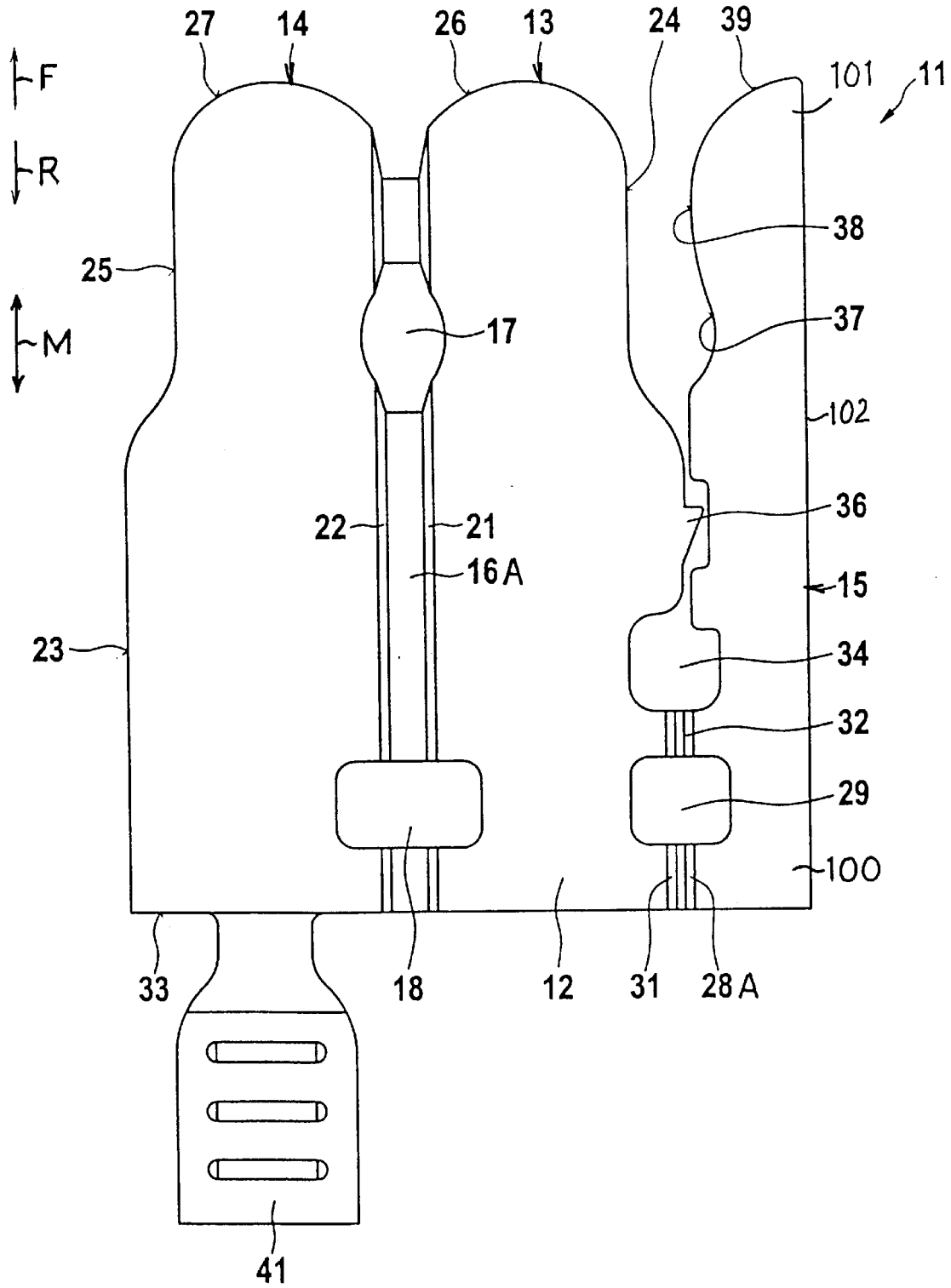
FIG. 1 is a plan view of a piece of sheet metal that is a punched blank from which a contact of a first embodiment of the invention can be formed.

FIG. 1 illustrates a piece of sheet metal 11 that has been punched from a larger sheet and that forms a punched blank. The blank forms two outer plates, or guide plates 13, 14 and an inner plate, or bias plate 15. The two guide plates are joined by a wide first bend region 16A. The first guide plate 13 is joined to the bias plate 15 by a narrow second bend region 28A.

The first bend region 16A extends along almost the entire length of the blank 11 which will become the contact, in front F and rear R directions, which are longitudinal M directions. The first bend region has two openings or recesses 17, 18. The first recess 17 is used to receive a mating terminal and to latch the contact formed by the blank 11 to a mating connector, as will be described below. The wide bend region forms lower ends 21, 22 of the guide plates. The second bend region 28A extends only a short distance, along the rear portion 100 of the blank that will form the contact, with only one closed recess 29 therealong. A front portion 101 of the blank lies opposite the rear portion. The front and rear portions form front and rear portions of the contact and of the plates. The second bend region 28A forms upper ends 31, 32 of the guide plate 13 and bias plate 15. Applicant notes that the blank is formed with a punched region 34 and with a holding tooth 36. The bias plate 15 has a rounded front end 39, a convex nose at 38, and a concave zone 37 rearward of the nose.

The guide plates form front ends at 26 and 27, shoulders at 24, 25, an edge at 23 and a rear end at 33. A crimp projection 41 projects from one of the guide plates, and can be crimped around a wire to connect the wire to the contact.

Figures 2, 2A:
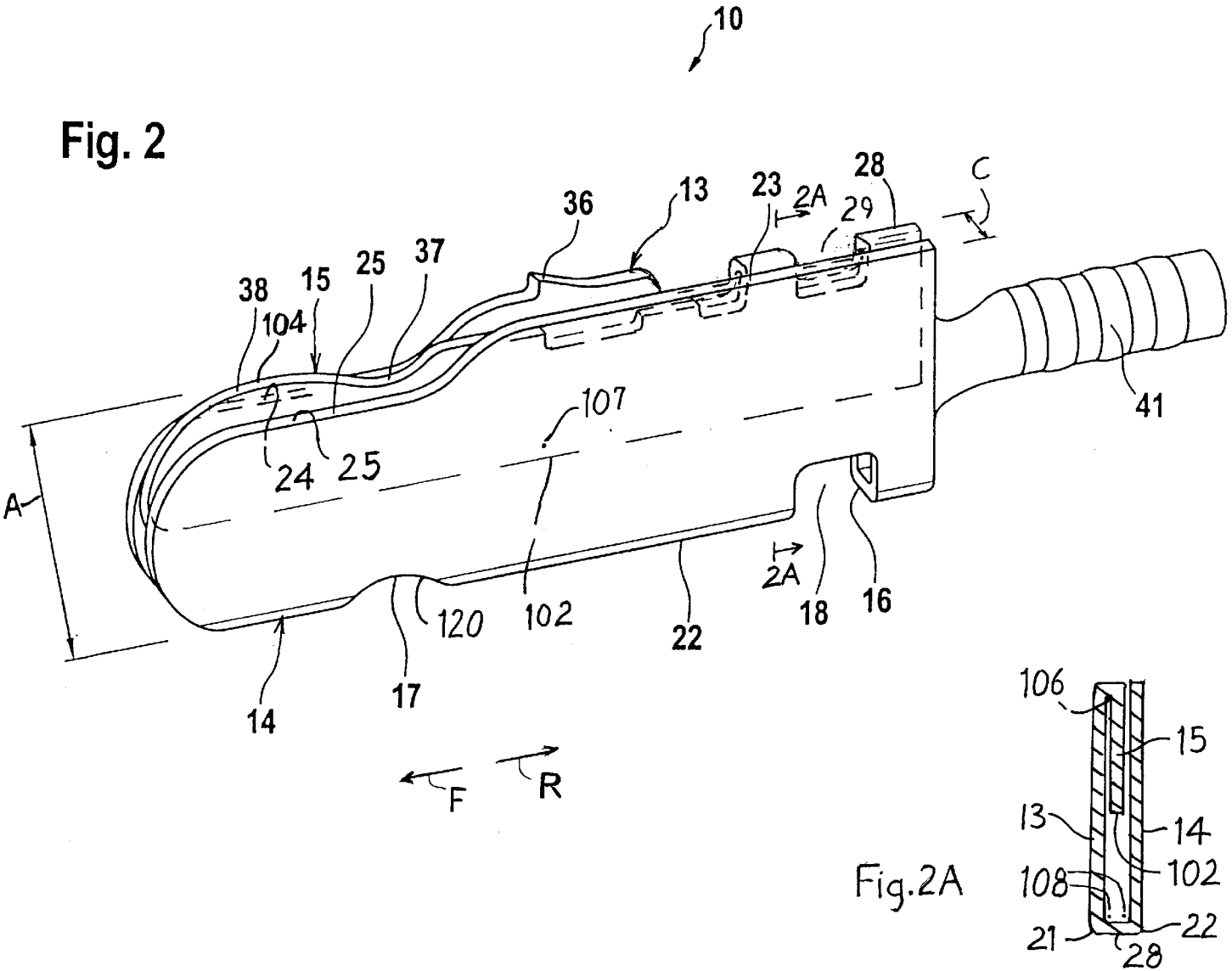
FIG. 2 is a front and top isometric view of a contact formed from the punched blank of FIG. 1.
FIG. 2A is a sectional view taken on line 2A—2A of FIG. 2.

FIG. 2 shows the blank folded to form a contact 10 which includes the two guide plates 13, 14 joined at a first bend 16 formed at lower ends of those plates, and the bias plate 15 which is joined by a second upper bend 28 to the upper end of the first guide plate 13. The front end of the upper bend is closer to the rear end of the contact than the middle 107. As shown in FIG. 2A, the bias plate 15 is sandwiched between the first and second guide plates 13, 14, and the plates lie facewise adjacent to one another. It is also noted that the bias plate has a lower end 102 which is much higher than the lower ends 21, 22 of the guide plates. The lower and upper bends are longitudinal bends because they are bends about longitudinal axes such as 106 and 108 (FIG. 2A).

FIG. 2 shows that the convex nose 38 initially projects above adjacent locations 24, 25 at the upper ends or tops of the guide plate front portions. However, the bias plate is resiliently deflectable downwardly, and in this case it can be deflected downwardly so that the top 104 of the nose is at the same height as the locations 24, 25 on the guide plates.

Figure 4A:
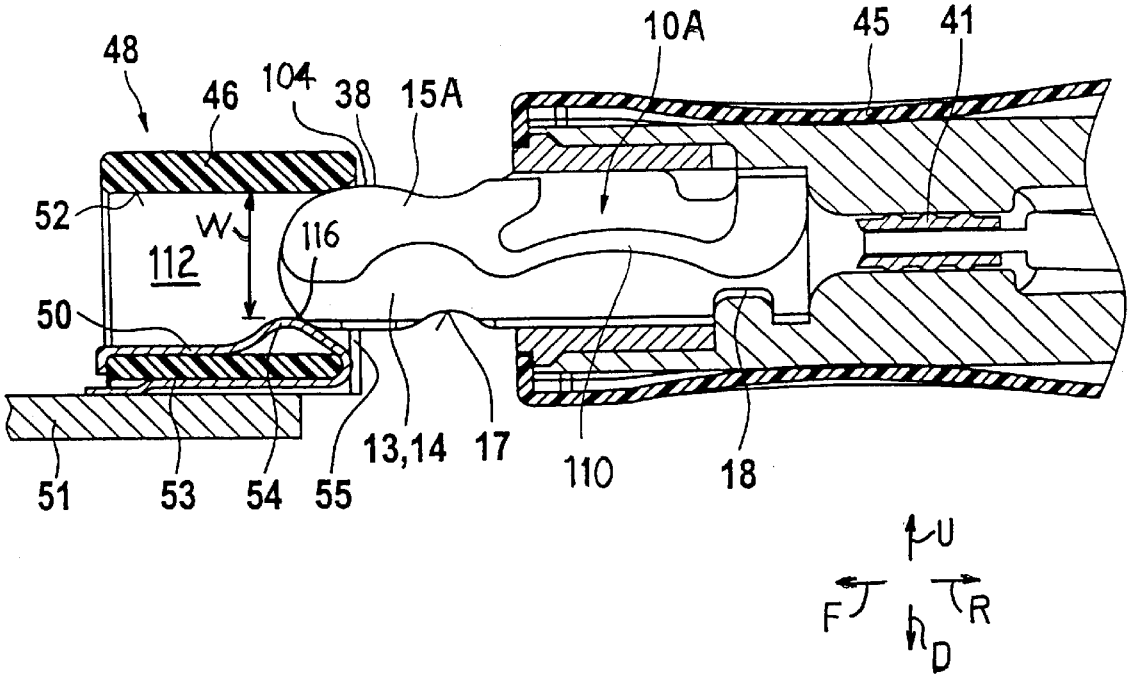
FIG. 4A is a view of the connectors of FIG. 3, shown at the beginning of mating of the connectors.

FIG. 4A illustrates a modified form of the contact at 10A, wherein the bias plate at 15A has a portion 110 of increased resilience. The increased resilience portion has a length between its front and rear ends that is more than six times its height in the up U and down D directions.

Figure 3:
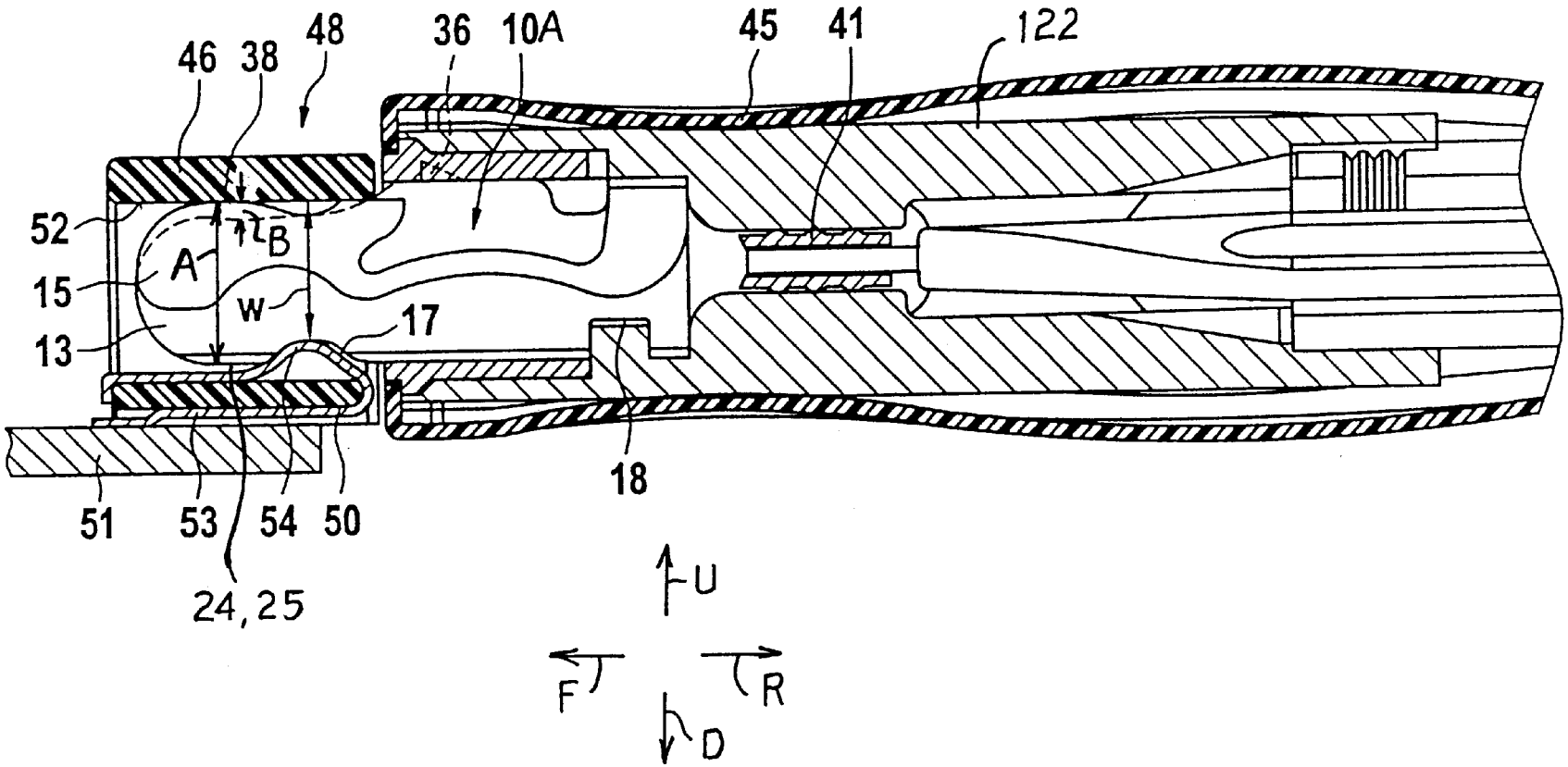
FIG. 3 is a sectional side view of two connectors in a fully mated position, and including a modified version of the contact of FIG. 2 mounted in a first connector and a terminal mounted in a second connector.
Figure 4B:
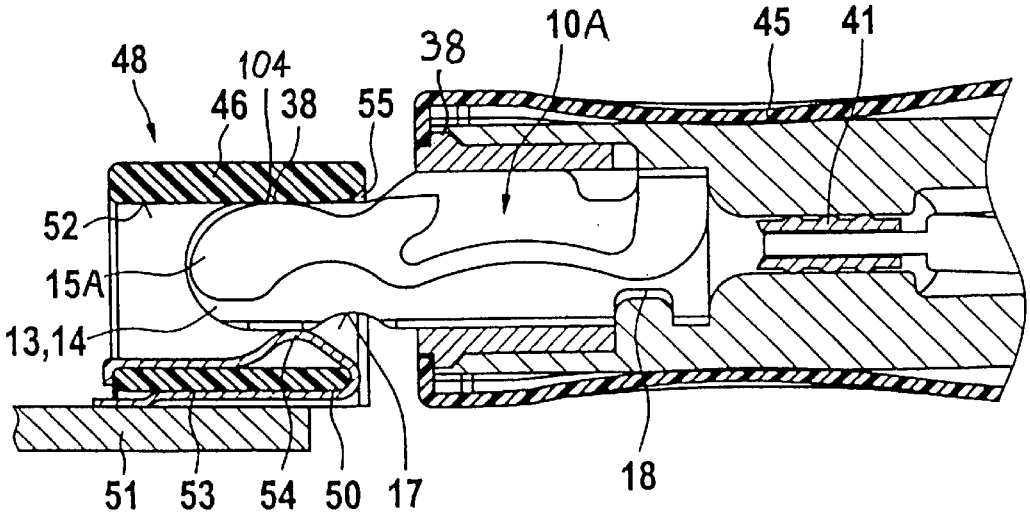
FIG. 4B is a view similar to FIG. 4A, but with the connectors in a position halfway between the beginning of mating position of FIG. 4A and the fully mated position of FIG. 3.

FIG. 4A shows the contact as it first enters a cavity 112 of the mating connector 48 and engages a partially rearwardly-facing terminal shoulder 116. The height of the front of the contact under the top 104 is greater than the height W between the top and bottom walls 52, 50 near the entrance of the cavity. A projecting portion 54 of the mating connector terminal 50 forms the lower wall of the cavity. The height of the contact 10A under the top 104 is greater than the vertical distance W at the entrance to the cavity. As shown in FIG. 4B, the squeezing force between the top and bottom walls of the cavity results in the nose 38 of the bias plate being downwardly resiliently deflected to the height W. FIG. 3 shows the connectors fully mated. The nose 38 of the bias plate has moved up again relative to the guide plates as the shoulders 24, 25 of the guide plates move down.

In the fully inserted position of FIG. 3, the projecting portion, or latching nose 54 of the terminal 50 enters the recess 17 at the lower ends of the two guide plates. The walls of the recess 17 form partially rearwardly-facing shoulders at 120 (FIG. 2) and the upper surface of the latching nose 54 forms a partially forwardly-facing shoulder. The shoulders engage and prevent the contact from being withdrawn rearwardly from the mating connector 48, without downwardly deflecting the nose 38 on the bias plate relative to the guide plates, to the position shown in FIG. 4B. The moderately long downward travel B of the nose 38, required for a pullout of the contact, results in a reliable latching of the two connectors together. The distance B is preferably at least 5% of the total height A of the cavity and of the contact front portion that enters the mating connector cavity.

FIG. 3 shows that the contact 10A is held in place in an insulative housing 122 of the first connector 45 by a portion of the first connector entering the recess 18 at the bottom of the rearward end of the guide plates, and by the holding tooth 36. The crimp projection 41 is shown crimped around a conductor of a wire. The connector has a plurality of contacts of the type illustrated at 10 or 10A whose latchings result in the requirement for a considerable pull out force to separate the connectors. The second connector comprises a circuit board 51, the lower end 53 of the terminal soldered to the board. The terminal has about the same width C as the contact.

While terms such as "top", "bottom", etc. have been used to describe the contacts and connectors as they are illustrated, it should be understood that the contacts and connectors can be used in any orientation with respect to the Earth.

Thus, the invention provides a contact for mounting in a first connector and for mating with a terminal of a second connector, wherein the contact has a front portion that can resiliently expand and contract in height, and that can be used to provide large and reliable latching forces to hold the connectors releaseably latched together. The contact includes a piece of sheet metal that is bent to form a guide plate and a bias plate, with a bend in the sheet metal that connects them so they lie facewise adjacent to one another. The bias plate has a front portion that is resiliently deflectable downwardly and that springs up again, so the bottom of the guide plate can engage a bottom wall of a cavity while the top of the front portion of the bias plate can engage an upper end of the cavity. The bottom of the guide plate (or the top of the bias plate) can have a recess that receives a projection of the mating connector, the projection preferably being the terminal that makes electrical engagement with the contact. Shoulders on the walls of the recess and on the terminal abut to resist rearward movement of the contact out of the cavity, although such rearward movement can be achieved by sufficient pullout force to downwardly deflect the front portion of the bias plate with respect to the bias plate(s).

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A contact for engaging a terminal, wherein:

said contact includes a piece of sheet metal that has at least one bend to form a bias plate and at least a first guide plate lying facewise adjacent and in largely parallel planes and joined at said bend, said contact and said bias and guide plate having front and rear portions;

said guide plate front portion has a lower end that lies below a lower end of the front portion of said bias plate;

said bias plate front portion has a top that initially extends above a top of said guide plate front portion and said bias plate top can be resiliently deflected downward relative to said guide plate, to thereby enable resilient compression of said contact front portion.

2. The contact described in claim 1 wherein:

said bottom of said guide plate front portion has a recess, to thereby receive a portion of the terminal.

3. The contact described in claim 1 wherein:

said guide plate has a rearward crimp projection that is crimpable to a wire.

4. The contact described in claim 1 including a mating connector which includes said terminal, and wherein:

said mating connector has a cavity for receiving said contact front portion, said cavity having vertically spaced first and second opposite receptacle walls, said terminal forming the second of said receptacle walls and the vertical distance between said terminal and said first receptacle wall is small enough to resiliently downwardly deflect said bias plate front portion relative to said guide plate during forward insertion of said contact front portion into said cavity.

5. The contact described in claim 1 including said terminal, and wherein:

said guide plate has a lower edge with recess walls forming a recess therein;

said terminal has an upward projection with a convex upwardly-facing surface that lies in said recess, said projection having a partially forwardly-facing first shoulder, and said recess walls form a partially rearwardly-facing second shoulder that is positioned to engage first shoulder to resist rearward movement of said contact.

6. The contact described in claim 1 wherein:

said piece of sheet metal includes a second guide plate joined in a bend to one of the other plates and lying in a plane that is largely parallel to the planes of said first guide plate and bias plate, said bias plate sandwiched between said first guide plate and said second guide plate.

7. The contact described in claim 6 wherein:

said first guide plate and said second guide plate are joined in a bend.

8. The contact described in claim 6 wherein:

said first and second guide plates have lower portions that are joined in a longitudinal bend that extends in front and rear directions;

said contact has a recess that extends into said longitudinal bend.

9. A contact for mounting in a housing of a first connector and for engaging a terminal of a mating second connector, wherein:

said contact includes a piece of sheet metal that is bent to form three facewise adjacent plates in largely parallel planes, including a pair of outer plates and an inner plate sandwiched between said outer plates, said plate front portions have upper and lower ends, and each plate has longitudinally spaced front and rear portions;

the front portion of said inner plate has an upper end lying above adjacent locations on upper ends said outer plates, said inner plate having a lower end lying at a greater height than adjacent locations on lower ends of said outer plates, and said inner plate front portion is resiliently deflectable downwardly to resiliently reduce the effective height of the front portion of the contact.

10. The contact described in claim 9 wherein:

said outer plates are joined at their bottoms by a bottom longitudinal bend, and a first of said outer plates and said inner plate are joined at their upper ends by a top longitudinal bend.

11. The contact described in claim 9 wherein:

said inner plate has a height and has a longitudinal length that is at least six times its height, whereby to enable resilient downward bending of said inner plate front portion.

12. The contact described in claim 9 wherein:

the front portion of at least one of said plates, forms a largely vertically extending recess.

13. The contact described in claim 9 wherein:

lower ends of said outer plates are joined together by a longitudinally-extending lower bend, said lower bend having front and rear ends lying closest, respectively, to front and rear ends of said outer plate;

said outer plates form a terminal-receiving recess in said lower bend.

14. The contact described in claim 9 wherein:

a first of said outer plates and said inner plate, each have upper ends joined in a longitudinally-extending bend lying only at the rear ends of said plates.

15. The contact described in claim 9 including said housing of said first connector, said housing having a slot and said contact lies in said slot, and wherein:

lower ends of said outer plates are joined together by a longitudinally-extending lower bend, said lower ends of said outer plates having a slot extending into said lower bend;

said second connector has a retention projection that projects into said slot.

16. A combination of first and second connectors that each have an insulator, said first connector having a contact mounted to the insulator of said first connector and said second connector having a terminal, wherein:

said contact comprises a piece of sheet metal bent to form a guide plate and a biasing plate that are joined by a bend, said plates lying facewise adjacent to each other and in largely parallel planes and having front portions with upper and lower ends, said biasing plate being resiliently deflectable downward from an initial position, wherein said biasing plate front portion upper end lies above said guide plate front portion upper end, to a deflected position wherein the upper ends of said plate front portions are at substantially the same heights, said guide plate front portion lower end lying below said biasing plate front portion lower end in said initial and deflected positions;

the insulator of said second connector forming a cavity with vertically spaced upper and lower cavity walls, for receiving a front of said contact between them, said terminal lying at one of said cavity walls, said cavity having an entrance with a height that is small enough to deflect said biasing plate from said initial position to said deflected position, to thereby cause vertical pressure of said contact against said terminal.

17. The combination described in claim 16 wherein:

said guide plate lower end has a recess spaced rearward of a front end of said guide plate;

said terminal has a projecting portion that lies in said recess, with said biasing plate front portion upper end lying above said guide plate front portion upper end and pressing upward against a wall of said cavity upper end.

* * * * *